US005471926A

United States Patent [19]

Junghans et al.

[11] Patent Number: 5,471,926

[45] Date of Patent: Dec. 5, 1995

[54] PRINTING PRESS AND METHOD OF OPERATING SAME

[75] Inventors: Rudi Junghans, Wilhelmsfeld; Mathias Zuber, Helmstadt-Bargen, both of Germany

[73] Assignee: Heidelberger Druckmaschinen Aktiengesellschaft, Heidelberg, Germany

[21] Appl. No.: 228,136

[22] Filed: Apr. 14, 1994

[30] Foreign Application Priority Data

Apr. 16, 1993 [DE] Germany ..... 930742 U

[51] Int. Cl.[6] ..... B41L 23/00

[52] U.S. Cl. ..... 101/148; 101/348; 101/349

[58] Field of Search ..... 101/147, 148, 101/348, 349, 350

[56] References Cited

U.S. PATENT DOCUMENTS

| | | | |
|---|---|---|---|
| 3,552,311 | 1/1971 | Petri | 101/148 |
| 3,613,575 | 10/1971 | Kantor | 101/148 |
| 3,911,815 | 10/1975 | Bawfer | 101/148 |
| 4,016,811 | 4/1977 | Zauodny | 101/148 |
| 4,287,827 | 9/1981 | Warner | 101/148 |
| 4,440,081 | 3/1984 | Beisel . | |
| 4,601,242 | 7/1986 | Fadner . | |
| 4,603,634 | 8/1986 | Fadner . | |
| 4,619,198 | 10/1986 | Moll | 101/148 |
| 4,722,274 | 2/1988 | Jeschke et al. | 101/349 |
| 4,724,764 | 2/1988 | MacPhee | 101/349 |
| 4,903,320 | 2/1991 | Kochsmeier | 101/148 |
| 4,922,818 | 5/1990 | Junghans | 101/148 |

FOREIGN PATENT DOCUMENTS

| | | |
|---|---|---|
| 0316515 | 5/1989 | European Pat. Off. . |
| 0396114 | 11/1990 | European Pat. Off. . |
| 1808909 | 6/1970 | Germany . |
| 3146223 | 6/1983 | Germany . |

*Primary Examiner*—Eugene M. Eickholt
*Attorney, Agent, or Firm*—Nils H. Ljungman & Associates

[57] ABSTRACT

A printing press and a method operating the same. The printing press includes: a frame; a plate cylinder being rotatably mounted on the frame; an inking unit for supplying ink to the plate cylinder. The inking unit comprises: an ink fountain for containing ink; a plurality of inking rollers; means for transferring ink between said ink fountain and said plurality of inking rollers; a plurality of ink applicator rollers for transferring ink between said plurality of inking rollers and said plate cylinder. The printing press further includes a dampening unit for supplying damping medium to said plate cylinder. The dampening unit comprises a form roller having an elastic outer cylindrical surface which can be engaged at the printing plate of a plate cylinder, a driven dampening distributor having a chromium outer cylindrical surface and being assigned to the form roller, and further dampening-unit rollers supplying the form roller with the dampening medium contained in a dampening-medium vessel. The dampening distributor is preferably provided with cups arranged close to each other and preferably featuring each a depth of approximately 20 micrometers, and, preferably, the ridges between the cups: are rounded off; permeate the dampening-medium film and the ink film on the form roller; and, under a certain contact pressure, are in contact with the outer cylindrical surface of the form roller and drive the form roller.

20 Claims, 4 Drawing Sheets

FIG. 1a
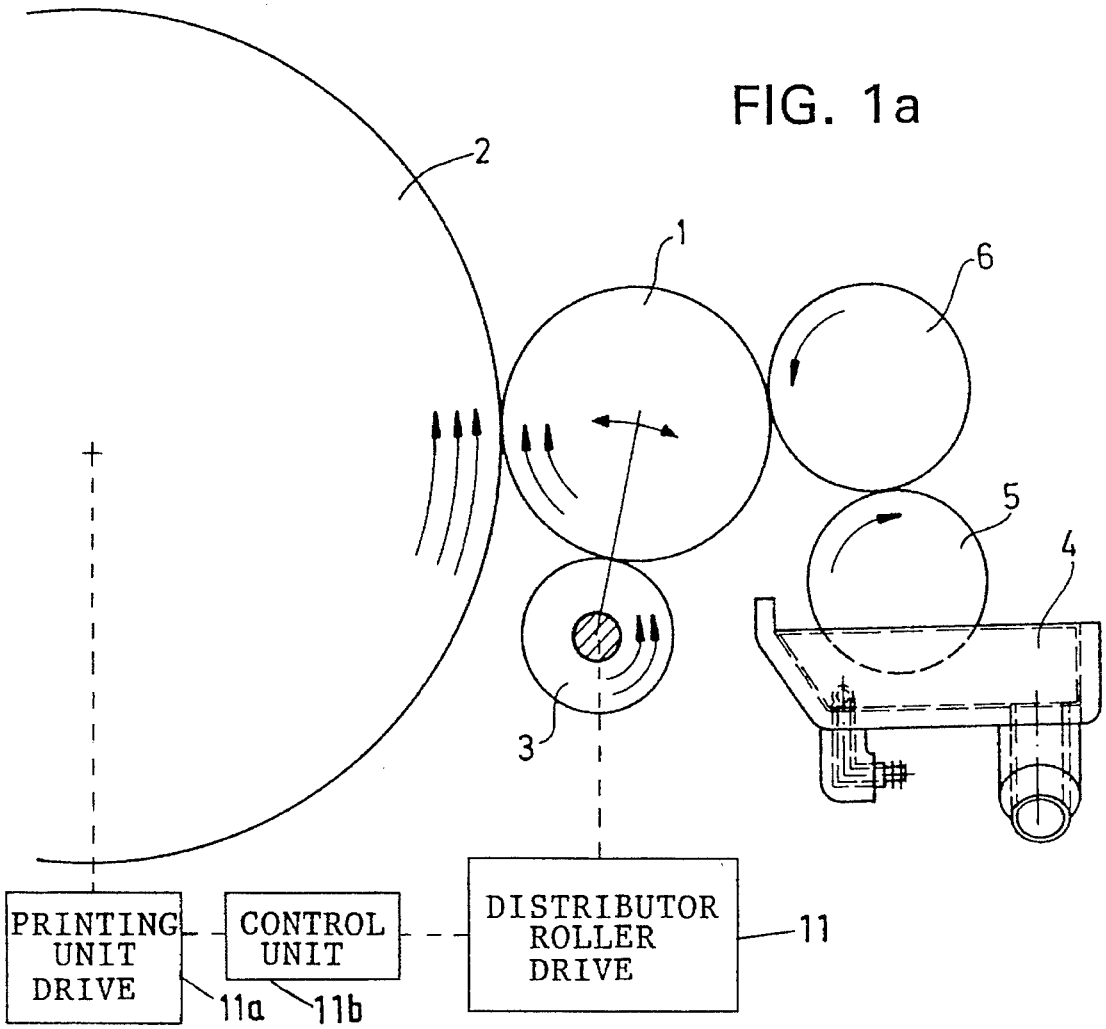
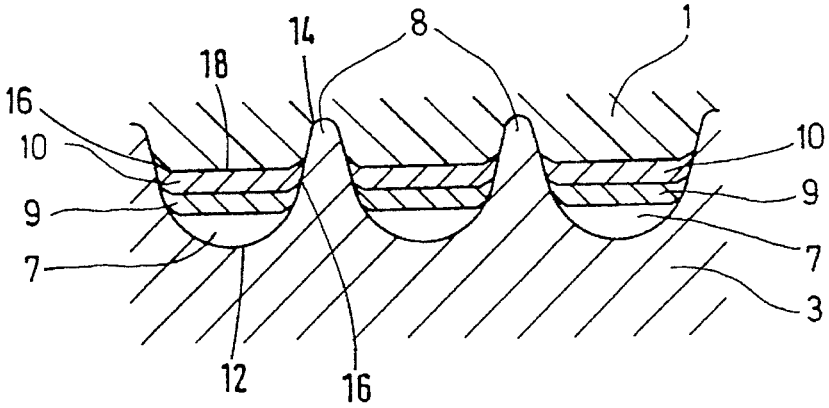
FIG. 2a

PRINTING PRESS AND METHOD OF OPERATING SAME

BACKGROUND OF THE INVENTION

1. Field of the Invention

The present invention generally relates to a printing press and more specifically to an offset printing press having: a frame; a plate cylinder being rotatably mounted on the frame; an inking unit for supplying ink to the plate cylinder. The inking unit comprises: an ink fountain for containing ink; a plurality of inking rollers; means for transferring ink between said ink fountain and said plurality of inking rollers; a plurality of ink applicator rollers for transferring ink between said plurality of inking rollers and said plate cylinder. The printing press further includes a dampening unit for supplying damping medium to said plate cylinder. The dampening unit comprises: a forme roller having an elastic outer cylindrical surface, the form roller being engageable at a printing plate of a plate cylinder; a driven dampening distributor having a chromium outer cylindrical surface and being assigned to the forme roller; and further dampening-unit rollers supplying the forme roller with the dampening medium contained in a dampening-medium vessel.

2. Background Information

An arrangement such as that described above is known from German Patent No. 31 46 223 C2, corresponding to U.S. Pat. No. 4,440,081 (Apr. 3, 1984), in which an additional dampening distributor having a rough outer cylindrical surface intensively works the dampening water, or damping medium, into the ink film disposed therebeneath in order to form an emulsion. With this known embodiment, the dampening forme roller always essentially rotates at the circumferential speed of the plate cylinder.

If a forme roller is to be driven at a lower speed than the plate cylinder so as to eliminate dirt particles from the plate surface, it is known to fasten a gear rim, possibly on the front side of the plate cylinder between the machine side frames. Such a gear rim would essentially transmit the drive of the forme roller via a gearwheel provided on the front side of the forme roller. Alternatively, the forme roller can be driven via a separate motor which ensures that the circumferential speed of the forme roller is lower than the circumferential speed of the plate cylinder (German Patent No. 18 08 909 C3). Such drives can have the disadvantage that the gearwheels are not sufficiently provided with lubricating oil, which leads to a higher degree of wear and tear. Moreover, there is the risk of the print product being soiled by lubricating oil. Furthermore, it has appeared that the gear drive of the forme roller may cause so-called "gear marks", which would mean that the ink and/or the dampening medium is not uniformly transferred onto the print product. As a result thereof, marks extending transversely to the print direction would be seen. This effect can potentially produce waste paper.

OBJECT OF THE INVENTION

On the basis of the facts set forth above, it is an object of the present invention to create a friction drive for the forme roller which eliminates the disadvantages discussed above and permits a difference in speed between the forme roller and the plate cylinder.

SUMMARY OF THE INVENTION

According to the invention, the above object is achieved in that the outer cylindrical surface of the dampening distributor is provided with cups which are arranged close to one another and each preferably feature a depth of approximately 20 micrometers, and in that the ridges between the cups are preferably rounded off, permeate through the dampening-medium/ink film on the forme roller, and contact the outer cylindrical surface of the forme roller. Such a design of the dampening distributor essentially provides an exact drive connection with the forme roller which, in an uncomplicated manner, permits essentially any difference in speed between forme rollers and plate cylinder. The drive essentially does not require any spur gears between the machine side frames so that, with this solution, a normal drive of the additional dampening distributor suffices. By appropriately designing the mechanism driving the dampening distributor, essentially any circumferential speeds of the forme roller can be possible and can be activated.

In summary, one aspect of the invention resides broadly in a printing press comprising: a frame; a plate cylinder being rotatably mounted on said frame; an inking unit for supplying ink to said plate cylinder; said inking unit comprising: an ink fountain for containing ink; a plurality of inking rollers; means for transferring ink between said ink fountain and said plurality of inking rollers; a plurality of ink applicator rollers for transferring ink between said plurality of inking rollers and said plate cylinder; a damping unit for supplying damping medium to said plate cylinder; said damping unit comprising: a damping medium reservoir for containing damping medium; a form roller, being disposed adjacent said plate cylinder, for transferring damping medium to said plate cylinder; means for transferring damping medium from said damping medium reservoir to said form roller; a distributor roller, being disposed adjacent said form roller, for being rotatingly engaged with said form roller; said distributor roller comprising: an outer cylindrical surface for engaging with said form roller; a rotational axis; said outer cylindrical surface having a longitudinal dimension defined parallel to said rotational axis and a circumferential dimension defined perpendicular to the longitudinal dimension; a plurality of depressed areas disposed in said outer cylindrical surface of said distributor roller; a plurality of protruding areas separating said plurality of depressed areas from one another; a substantial number of said plurality of depressed areas being disposed one after the other over at least a major portion of the longitudinal extent of said outer cylindrical surface of said distributor roller; and a substantial number of said plurality of depressed areas being disposed one after the other over at least a major portion of the circumferential extent of said outer cylindrical surface of said distributor roller.

Another aspect of the invention resides broadly in a method of operating a printing press, such a printing press comprising: a frame; a plate cylinder being rotatably mounted on the frame; an inking unit for supplying ink to the plate cylinder; the inking unit comprising an ink fountain for containing ink, a plurality of inking rollers, means for transferring ink between the ink fountain and the plurality of inking rollers, a plurality of ink applicator rollers for transferring ink between the plurality of inking rollers and the plate cylinder; a damping unit for supplying damping medium to the plate cylinder; the damping unit comprising: a damping medium reservoir for containing damping medium; a form roller, being disposed adjacent the plate cylinder, for transferring damping medium to the plate cylinder; means for transferring damping medium from the damping medium reservoir to the form roller, the form roller having an outer surface; means for driving the distributor roller; the distributor roller for being disposed adjacent the form roller, for being rotatingly engaged with the form roller; said method comprising the steps of: providing a frame; providing a plate cylinder and rotatably mounting the plate cylinder on the frame; providing an inking unit for supplying ink to the plate cylinder; said step of providing the inking unit comprising: providing an ink fountain for containing ink; providing a plurality of inking rollers; providing means for transferring ink between the ink fountain and the plurality of inking rollers; providing a plurality of ink applicator rollers for transferring ink between the plurality of inking rollers and the plate cylinder; providing a damping unit for supplying damping medium to the plate cylinder; said step of providing the damping unit comprising: providing a damping medium reservoir for containing damping medium; providing a form roller and disposing the form roller adjacent the plate cylinder, for transferring damping medium to the plate cylinder, the form roller having an outer surface; providing means for transferring damping medium from the damping medium reservoir to the form roller; providing a distributor roller and disposing he distributor roller adjacent the form roller, the distributor roller for being rotatingly engaged with the form roller; providing means for driving the distributor roller; said step of providing the distributor roller comprising: providing an outer cylindrical surface for engaging with the form roller; configuring the distributor roller to rotate about a rotational axis; configuring the outer cylindrical surface to have a longitudinal dimension defined parallel to the rotational axis and a circumferential dimension defined perpendicular to the longitudinal dimension; disposing a plurality of depressed areas in the outer cylindrical surface of the distributor roller; providing a plurality of protruding areas, such that the plurality of protruding areas separate the plurality of depressed areas from one another; configuring the distributor roller driving means and the plurality of protruding areas to provide means for making contact with the outer surface of the form roller; and configuring the distributor roller driving means and the plurality of protruding areas to provide means for transferring a rotational driving force to the outer surface of the form roller to drive the form roller; said method further comprising the additional steps of: driving the distributor roller with the means for driving the distributor roller; and driving the form roller, simultaneously with said step of driving the distributor roller, by transferring, with the plurality of protruding areas, a rotational driving force from the distributor roller to the form roller.

Yet another aspect of the invention resides broadly in a distributor roller for a printing press, such a printing press comprising: a frame; a plate cylinder being rotatably mounted on the frame; an inking unit for supplying ink to the plate cylinder; the inking unit comprising an ink fountain for containing ink, a plurality of inking rollers, means for transferring ink between the ink fountain and the plurality of inking rollers, a plurality of ink applicator rollers for transferring ink between the plurality of inking rollers and the plate cylinder; a damping unit for supplying damping medium to the plate cylinder; the damping unit comprising: a damping medium reservoir for containing damping medium; a form roller, being disposed adjacent the plate cylinder, for transferring damping medium to the plate cylinder; means for transferring damping medium from the duping medium reservoir to the form roller, the form roller having an outer surface; means for driving the distributor roller; said distributor roller for being disposed adjacent the form roller, for being rotatingly engaged with the form roller; said distributor roller comprisings an outer cylindrical surface for engaging with the form roller; a rotational axis; said outer cylindrical surface having a longitudinal dimension defined parallel to said rotational axis and a circumferential dimension defined perpendicular to the longitudinal dimension; a plurality of depressed areas disposed in said outer cylindrical surface of said distributor roller; a plurality of protruding areas separating said plurality of depressed areas from one another; said plurality of protruding areas and said distributor roller driving means being configured to provide means for making contact with the outer surface of the form roller; and said plurality of protruding areas and said distributor roller driving means being configured to provide means for transferring a rotational driving force to the outer surface of the form roller to drive the form roller.

BRIEF DESCRIPTION OF THE DRAWINGS

A specimen embodiment of the present invention is schematically illustrated in the drawings, wherein:

FIG. 1*a* is essentially the same view as FIG. 1, but more detailed;

FIG. 2*a* is essentially the same view as FIG. 2, but more detailed;

DESCRIPTION OF THE PREFERRED EMBODIMENT

Figure 1:
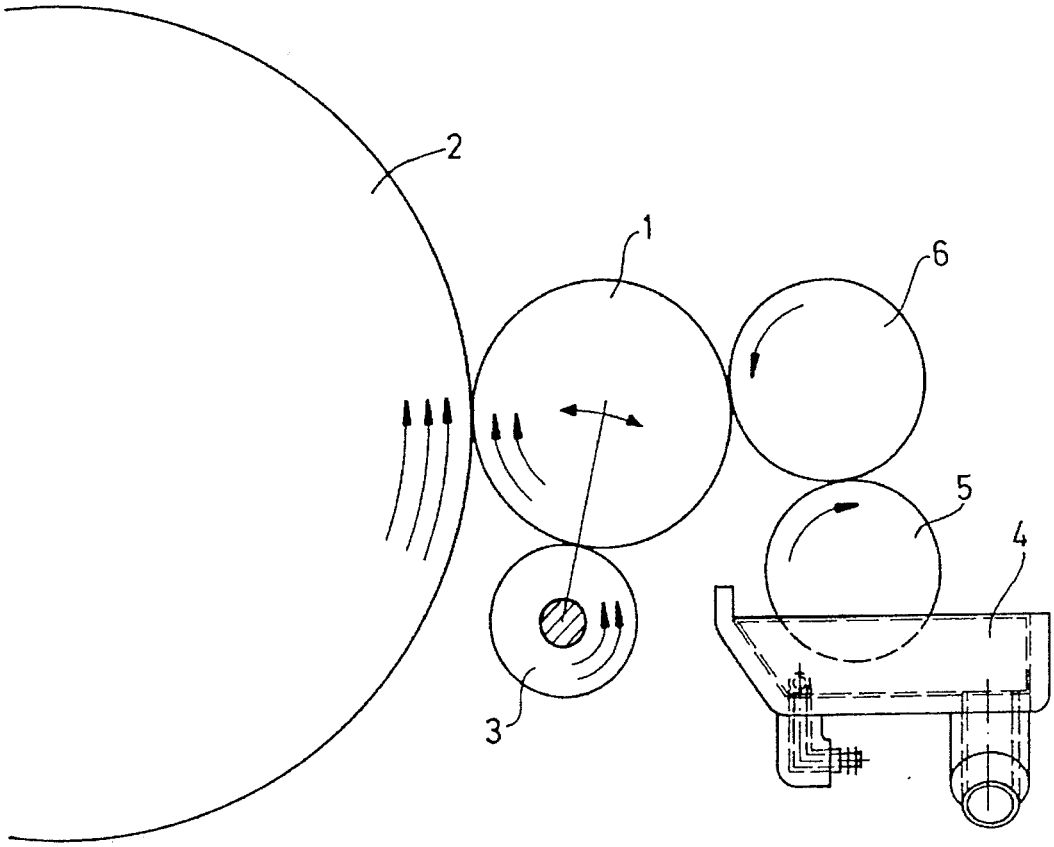
FIG. 1 is a schematic side elevational view of a dampening unit.
Figure 1B:
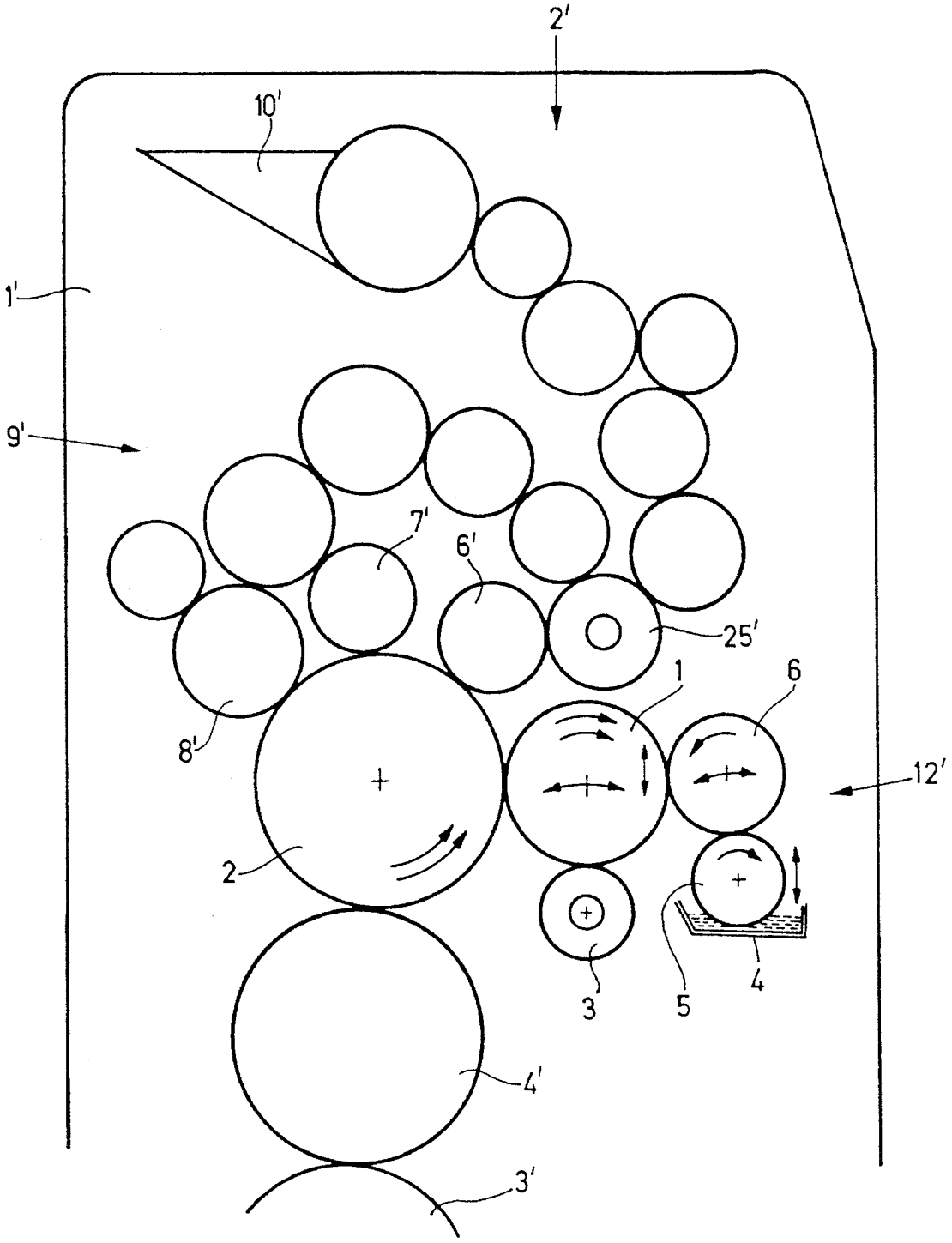
FIG. 1*b* illustrates a printing press which may employ a distributor roller in accordance with the present invention.

FIG. 1*b* illustrates a printing unit 2' which may employ a distributor roller 3 according to the present invention. Particularly, as shown in FIG. 5, an impression cylinder 3', blanket cylinder 4' and plate cylinder 2 are disposed between side frames 1' of the printing unit 2' in a known manner. Forme rollers 6', 7', 8' which, in a known manner, are supplied by the inking unit 9' with ink contained in an ink fountain 10', are assigned to plate cylinder 2.

viewed in direction of rotation of the plate cylinder 2, which direction is indicated by arrows in the drawings, forme roller 1 of a dampening unit 12' is followed by the forme rollers 6', 7', and 8'. Metering roller 6 for the dampening unit and dampening distributor roller 3 are preferably both in rolling contact with the forme roller 1. The required dampening medium is removed by pan roller 5 from dampening-medium pan 4 and transferred to the metering roller 6. The forme roller 1 and the forme rollers 6', 7', 8' are preferably mounted so as to be engageable with and disengageable from the plate cylinder 2. Furthermore, the metering roller 6 is preferably engageable with and disengagable from the forme roller 1, respectively, in order to interrupt the dampening-medium supply.

FIG. 1 shows a dampening unit in which a forme roller 1 transfers the dampening medium onto the printing plate of a plate cylinder 2. The forme roller 1 preferably has assigned thereto a driven dampening distributor 3. The damping medium distributor roller 3 preferably has a chromium outer cylindrical surface, whereas the forme roller 1 preferably has an elastic outer cylinderical surface, e.g. made of rubber. The required dampening medium can preferably be supplied by the forme roller onto the printing plate of the plate cylinder 2. As indicated by the arrows provided at the individual cylinders and rollers, the plate cylinder 2 may preferably be driven at a higher speed than the forme roller 1 and the distributor roller 3, whereas the dampening-unit rollers 5, 6 can preferably rotate at an even lower circumferential speed. The dampening distributor 3 is preferably connected with the drive of the printing unit via a drive not illustrated.

FIG. 1*a* is essentially the same view as FIG. 1, but additionally illustrates a drive 11 for driving the distributor roller 3. This drive 11 may preferably be connected with the drive of the printing unit, indicated at 11*a*, possibly via a control unit 11*b*, wherein the drive 11*a* of the printing unit would preferably be configured to drive at least the plate cylinder 2. Control unit 11*b* may preferably be configured to either ensure that distributor roller 3, and consequently forme roller 1, are driven at a rotational speed similar to that of the plate cylinder 2, or to ensure that motor 11 drives distributor roller 3, and consequently forme roller 1, at a rotational speed different from that of the plate cylinder 2.

Figure 2:
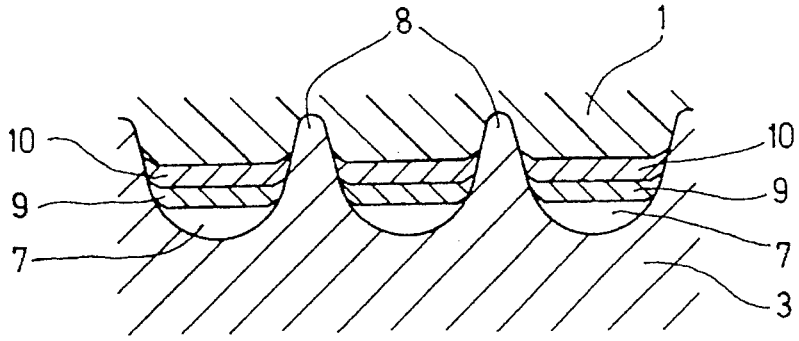
FIG. 2 is an enlarged fragmentary cross-sectional view of the cups or dimples according to the present invention.

FIG. 2 is an enlarged view of the outer cylindrical surface of the dampening distributor 3. The outer cylindrical surface of the dampening medium distributor 3 is preferably provided with cups 7 which arranged close to each other. Each of these cups preferably features a depth of approximately 20 micrometers. The ridges 8 between the cups 7 are preferably rounded off and are preferably configured to permeate the dampening-medium film 9 and the ink film 10 on the forme roller 1. The ridges 8 are preferably engaged at the outer cylindrical surface of the forme roller 1 under a certain contact pressure and are preferably pressed slightly into the rubber outer cylindrical surface. Accordingly, a substantially exact drive connection can preferably be provided with respect to the forme roller 1 so that the forme roller 1 may be driven at a different speed then the plate cylinder 2. At the same time, the dampening-medium film is preferably worked into the ink film by the distributor roller 3 in order to form a desired emulsion.

Thus, in other words, in accordance with a preferred embodiment of the present invention, the outer cylindrical surface of the dampening medium distributor roller 3 is preferably provided with a series of cup-like indentations 7, which may be alternatively termed "cups", "bowls", or "dimples". Ridges 8 between the cups are preferably rounded off and preferably penetrate the elastic material of the outer cylindrical surface of forme roller 1 slightly.

Preferably, the ridges 8 are configured to transmit a rotational driving force from distributor roller 3 to forme roller 1. Additionally, distributor roller 3 may preferably be configured to undergo a lateral oscillating motion in order to promote the intermingling of damping medium 9 and ink 10 to produce the desired emulsion. Such a lateral oscillating motion of a distributor roller, and the types of mechanisms for causing the same, are generally well-known to those of ordinary skill in the art and will not be further discussed here.

Preferably, the ridges 8 are configured such that, when a distributor roller 3 according to the present invention undergoes a lateral oscillating motion while simultaneously providing a rotational driving force to form roller 1, the elastic or rubber outer cylindrical surface of the forms-roller 1 will not be damaged. Conceivably, the roundedness of ridges 8 could contribute to such an effect. Additionally, the elastic outer cylindrical surface of the forme roller 1 may preferably be formed of a material which is capable of accepting a rotational driving force from ridges 8 while resisting any tearing from lateral motion of ridges 8 during oscillation of the distributor roller 3.

FIG. 2*a* is essentially the same view as FIG. 2, but more detailed. Particularly, indicated in FIG. 2*a* are rounded bottom portion 12 of cup 7, rounded top portion 14 of ridge 8, straight portion 16 connecting rounded portions 12 and 14, and outer cylindrical surface 18 of the forme roller 1.

In accordance with a preferred embodiment of the present invention, cups 7 are preferably generally rounded in shape, such that bottom portion 12 is essentially in the form of a truncated sperical surface. Top portion 14 is preferably rounded in such a way that, when viewed in cross-section through a cutting plane taken through the center of the speciral surface constituted by bottom portion 12, the cross-sectional shape of top portion 14 is generally in the form of a portion of a circle. Additionally, straight portion 16 is preferably in the form of a truncated conical surface. Preferably, truncated conical surface 16 connects with the curved shapes constituted by portions 12 and 14 at a tangent, so that, in each case, there is essentially a smooth, continuous transition without a point of inflection.

As mentioned above, each of the cups 7 can preferably have a total depth, as measured directly vertically from the apex of rounded top portion 14 to the apex of bottom rounded portion 12, of about 20 micrometers. Conceivably, this dimension could be in the range of from about 2 micrometers to about 200 micrometers, and could thus be any one of the following: 2 micrometers or less, 5 micrometers, 10 micrometers, 20 micrometers, 40 micrometers, 60 micrometers, 80 micrometers, 100 micrometers, 120 micrometers, 140 micrometers, 160 micrometers, 180 micrometers, or 200 micrometers or more; or any value intermediate to the values just listed.

The distance between apices of the top portions 14 of neighboring ridges 8, that is from the uppermost point of one rounded top portion 14 to that of another, which would preferably correspond to the distance between apices of bottom portions 12 of neighboring cups 7, that is from the lowermost point of one rounded bottom portion 12 to that of another, can preferably be about 32 micrometers. Conceivably, this dimension could be in the range of from about 3 micrometers to about 320 micrometers, and could thus be any one of the following: 3 micrometers or less, 6 micrometers, 8 micrometers, 16 micrometers, 32 micrometers, 40 micrometers, 80 micrometers, 120 micrometers, 160 micrometers, 200 micrometers, 240 micrometers, 280 micrometers, or 320 micrometers or more; or any value intermediate to the values just listed.

As illustrated in FIG. 2*a*, and in accordance with the dimensions listed above, each ridge 8 may preferably penetrate the outer cylindrical surface 18 of forme roller 1 to a depth of about 8 micrometers. Conceivably, this dimension could be in the range of from about 1 micrometer to about 80 micrometers, and could thus be any one of the following: 1 micrometer or less, 3 micrometers, 6 micrometers, 8 micrometers, 12 micrometers, 16 micrometers, 20 micrometers, 40 micrometers, 60 micrometers or 80 micrometers or more; or any value intermediate to the values just listed.

Bottom rounded portion 12 may preferably have a radius of curvature of about 10.9 micrometers. Conceivably, this dimension could be in the range of from about 1 micrometers to about 109 micrometers, and could thus be any one of the following: 1 micrometers or less, 2 micrometers, 4 micrometers, 6 micrometers, 10.9 micrometers, 15 micrometers, 21 micrometers, 27 micrometers, 40 micrometers, 60 micrometers, 80 micrometers, 100 micrometers, or 109 micrometers or more; or any value intermediate to the values just listed. Additionally, bottom rounded portion 12 may preferably describe an arc of about 115 degrees. Conceivably, this dimension could be in the range of from about 70 degrees to about 160 degrees, and could thus be any one of the following: 70 degrees or lees, 85 degrees, 100 degrees, 115 degrees, 130 degrees, 145 degrees, or 160 degrees or more.

Top portion 14 may preferably have a radius of curvature of about 2 micrometers. Conceivably, this dimension could be in the range of from about 0.2 micrometers to about 20 micrometers, and could thus be any one of the following: 0.2 micrometers, 0.4 micrometers, 0.8 micrometers, 1.2 micrometers, 1.6 micrometers, 2.0 micrometers, 4 micrometers, 6 micrometers, 8 micrometers, 12 micrometers, 16 micrometers, or 20 micrometers or more. Additionally, top portion 14 may preferably describe an arc of about 140 degrees Conceivably, this dimension could be in the range of from about 110 degrees to about 170 degrees, and could thus be any one of the following: 110 degrees or less, 120 degrees, 130 degrees, 140 degrees, 150 degrees, 160 degrees or 170 degrees or more.

Truncated conical surface 16 may preferably have a linear dimension, as measured along the conical surface between top portion 14 and bottom portion 12, of about 12.6 micrometers. Conceivably, this dimension could be in the range of from about 1.3 micrometers to about about 126 micrometers, and could thus be any one of the following: 1.3 micrometers or less, 2.6 micrometers, 4 micrometers, 8 micrometers, 12.6 micrometers, 15 micrometers, 20 micrometers, 25 micrometers, 30 micrometers, 40 micrometers, 60 micrometers, 80 micrometers, 100 micrometers, 120 micrometers, or 126 micrometers or more.

With regard to the dimensions listed hereinabove, a preferred ratios of some of the dimensions with respect to one another may be as follows:

IF:

the depth of cups 7 is understood to be dimension "A";

the distance between apices of the top portions 14 of neighboring ridges 8 (and, consequently, the distance between apices of the bottom portions 12 of neighboring cups 7) is understood to be dimension "B"; and the depth of penetration of the ridges 8 into the outer cylindrical surface 18 of form roller 1 is understood to be dimension "C";

THEN:

the ratio of dimensions A:B:C may be, according to a preferred embodiment of the present invention, approximately 5:8:2.

Furthermore, according to a preferred embodiment of the present invention, given the preferred ratio of dimensions just listed:

the partially circular cross-section constituted by top portion 14 preferably describes an arc of about 115 degrees;

bottom portion 12 preferably describes an arc of about 140 degrees; and truncated conical surface 16 preferably connects with the truncated sphere shapes constituted by portions 12 and 14 at a tangent, so that there is essentially a smooth, continuous transition without a point of inflection.

Figure 3:
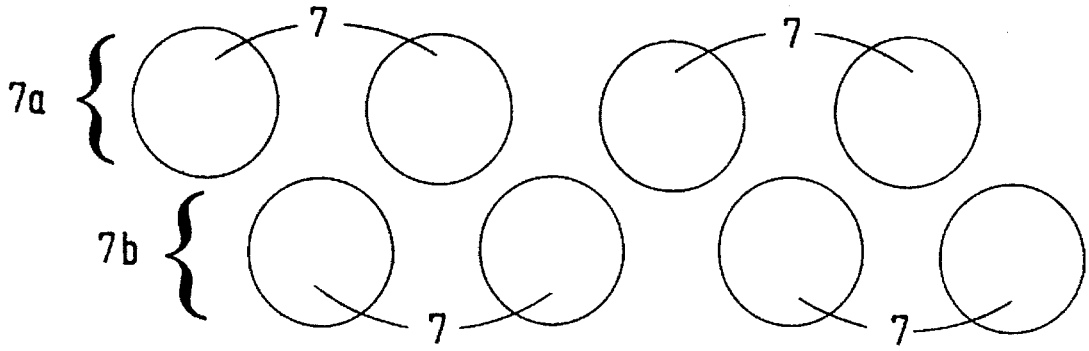
FIG. 3 schematically illustrates one possible pattern of the cups or dimples according to the present invention.

In accordance with a preferred embodiment of the present invention, FIG. 3 schematically illustrates one possible general layout, or pattern, of cups 7 on distrubutor roller 3. Particularly, according to the layout shwon in FIG. 3, one row 7*a* of cups 7 may preferably be offset with respect to a neighboring row of cups 7 in such a manner that diagonally adjacent cups 7 are separated by the same distance from one another as are adjacent cups 7 within a particular row 7*a* or 7*b*.

Figure 4:
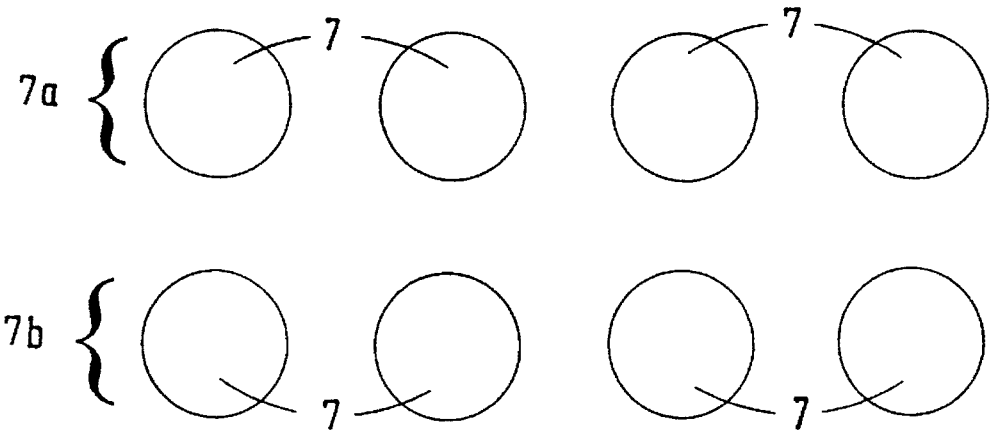
FIG. 4 schematically illustrates another possible pattern of the cups or dimples according to the present invention.

In accordance with another preferred embodiment of the present invention, FIG. 4 schematically illustrates another possible general layout, or pattern, of cups 7 on disttributor roller 3. Particularly, according to the layout shown in FIG. 4, one row 7*a* of cups 7 may preferably be aligned with respect to a neighboring row of cups 7 in such a manner that orthogonally adjacent cups 7 between rows 7*a* and 7*b* are separated by the same distance from one another as are adjacent cups 7 within a particular row 7*a* or 7*b*.

It should be understood that each "row" of cups 7*a* or 7*b*, as described and illustrated with reference to FIGS. 3 and 4, is preferably aligned parallel to the axis of rotationa of distributor roller 3. It should also be understood that whichever of the patterns illustrated in FIGS. 3 and 4 is employed, is preferably repeated over substantially the entire outer surface of the distributor roller 3. Alternatively, a hybrid of the patterns illustrated in FIGS. 3 and 4 may be employed, or even another type of pattern not specifically illustrated or described herein could conceivably be employed within the scope of the present invention.

In accordance with a preferred embodiment of the present invention, all of the dimensions listed above with reference to FIG. 2*a* preferably remain constant over substantially the entire outer surface of the distributor roller 3 and with respect to substantially every cup 7 end every ridge 8 disposed over substantially the entire outer surface of the distributor roller 3.

Within the scope of the present invention, it is conceivable to employ other types of arrangements for the outer surface of distributor roller 3 than those described hereinabove. For example, a distributor roller 3 according to the present invention may conceivably include parallel ridges 8 which remain parallel over substantially the entire outer surface of distributor roller 3 and do not form cups, bowls, dimples but form parallel valleys between ridges 8. Additionally, although the cups 7 described hereinabove are generally considered to be spherical in nature, it is conceivable for the cups 7 illustrated in FIGS. 2 to be embodied by small troughs, wherein such troughs would conceivably have the cross-section shown in FIG. 2 but would be bound at opposite ends by rectilinear edges.

It should be understood that, generally in accordance with a preferred embodiment of the present invention, the depth of penetration of ridges 8 into the outer cylindrical surface 18 of forme roller 1 essentially represents a preferred depth of penetration to be employed when it is intended that the distributor roller 3, by means of ridges 8, drive forme roller 1. During an operation or a period of time when it is not intended that the distributor roller 3, by means of ridges 8, drive forme roller 1, the distributor roller 3 can conceivably be retracted away from forme roller I so that the ridges 8 do not penetrate the outer cylindrical surface 18 of forme roller 1. Devices for affording such retractability are generally well-known to those of ordinary skill in the art.

One feature of the invention resides broadly in the dampening unit for an offset printing machine comprising a forme roller having an elastic outer cylindrical surface which can be engaged at the printing plate of a plate cylinder, a driven dampening distributor having a chromium outer cylindrical surface and being asssigned to the forme roller, and further dampening-unit rollers supplying the forme roller with the dampening medium contained in a dampening-medium vessel, characterized in that the outer cylindrical surface of the dampening distributor 3 is provided with cups 7 arranged close to each other and featuring each a depth of approximately 20 micrometers, and that the ridges 8 between the cups 7 are rounded off, permeate the dampening-medium film 9 and the ink film 10 on the forme roller 1 and, under a certain contact pressure, are in contact with the outer cylindrical surface of the forme roller 1 and drive said forme roller.

Examples of arrangements for retracting a roller or cylinder, such as a distributor roller, from engagement with respect to another roller cylinder, may be found in the following U.S. Pat. Nos. 5,174,209, which issued to Rodi et al. on Dec. 29, 1992; 4,922,818, which issued to Junghans et al. on May 8, 1990; and 4,711,172, which issued to Capdebosc on Dec. 8, 1987. Additionally, such arrangements may also be found in copending and commonly assigned U.S. patent application Ser. No. 07/931,259, which was filed on Aug. 17, 1992, in the name of Rudi Junghans.

Examples of driving arrangements for driving rollers and/or cylinders, control arrangements for coordinating the driven motion of rollers and cylinders and control arrangements for controlling the rectraction and engagement of different rollers and cylinders with respect to one another, may be found in the following U.S. Pat. Nos. 5,174,209, which issued to Rodi et al. on Dec. 29, 1992; 5,148,747, which issued to Rodi et al. on Sep. 22, 1992; 5,081,926, which issued to Rodi et al. on Jan. 21, 1992; 5,192,367, which issued to Hoffmann on Mar. 9, 1993; and 4,130,057, which issued to List et al. on Dec. 19, 1978.

Examples of rubber or elastic materials for rollers or cylinders, which may be utilized in accordance with the embodiments of the present invention, may be found in the following U.S. Pat. Nos. 4,949,637, which issued to Keller on Aug. 21, 1990; 4,440,081, which issued to Beisel on Apr. 3, 1984; 4,022,125, which issued to Weaver on Aug. 10, 1997; and 3,538,849.

Examples of printing presses, which may be utilized in accordance with the embodiments of the present invention, may be found in the following U.S. Pat. Nos. 5,170,706, which issued to Rodi et al. on Dec. 15, 1992; 5,081,926, which issued to Rodi on Jan. 21, 1992; and 5,010,820, which issued to Löffler on Apr. 30, 1991.

Examples of distributor rollers, and arrangements for ensuring axial displacement of such distributor rollers, which may be utilized in accordance with the embodiments of the present invention, may be found in the following U.S. Pat. Nos. 5,003,874, which issued to Junghans on Apr. 2, 1991; and 3,118,373, which issued to Mossmiller on Jan. 21, 1964.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if any, described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. G 93 05 742.3, filed on Apr. 16, 1993, having inventors Rudi Junghans and Mathias Zuber, and DE-OS G 93 05 742.3 and DE-PS G 93 05 742.3, as well as their published equivalents, and other equivalents or corresponding applications, if any, in corresponding cases in the Federal Republic of Germany and elsewhere, end the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. A printing press comprising:

a frame;

a plate cylinder being rotatably mounted on said free;

an inking unit for supplying ink to said plate cylinder;

said inking unit comprising:

an ink fountain for containing ink;

a plurality of inking rollers;

means for transferring ink between said ink fountain and said plurality of inking rollers;

a plurality of ink applicator rollers for transferring ink between said plurality of inking rollers and said plate cylinder;

a damping unit for supplying damping medium to said plate cylinder;

said damping unit comprising:

a damping medium reservoir for containing damping medium;

a form roller, being disposed adjacent said plate cylinder, for transferring damping medium to said plate cylinder;

means for transferring damping medium from said damping medium reservoir to said form roller;

a distributor roller, being disposed adjacent said form roller, for being rotatingly engaged with said form roller;

said distributor roller comprising:

an outer cylindrical surface for engaging with said form roller;

a rotational axis;

said outer cylindrical surface having a longitudinal dimension defined parallel to said rotational axis and a circumferential dimension defined perpendicular to the longitudinal dimension;

a plurality of depressed areas disposed in said outer cylindrical surface of said distributor roller;

a plurality of protruding areas separating said plurality of depressed areas from one another;

a substantial number of said plurality of depressed areas being disposed one after the other over at least a major portion of the longitudinal extent of said outer cylindrical surface of said distributor roller; and a substantial number of said plurality of depressed areas being disposed one after the other over at least a major portion of the circumferential extent of said outer cylindrical surface of said distributor roller.

2. The printing press according to claim 1, wherein said plurality of depressed areas are disposed substantially immediately adjacent one another, in a substantially uniform pattern, over a least a major portion of the longitudinal extent of said outer cylindrical surface of said distributor roller; and a major portion of the circumferential extent of said outer cylindrical surface of said distributor roller.

3. The printing press according to claim 2, wherein said plurality of depressed areas are disposed over:

substantially the entire longitudinal extent of said outer cylindrical surface of said distributor roller; and substantially the entire circumferential extent of said outer cylindrical surface of said distributor roller.

4. The printing press according to claim 3, wherein:

said plurality of depressed areas are arranged in a plurality of rows; and said plurality of rows are disposed parallel to one another.

5. The printing press according to claim 4, wherein:

said form roller has an outer surface;

said printing press further comprises means for driving said distributor roller;

said plurality of protruding areas and said distributor roller driving means are configured to provide means for making contact with the outer surface of the form roller; and said plurality of protruding areas and said distributor roller driving means are configured to provide means for transferring a rotational driving force to the outer surface of the form roller to drive the form roller.

6. The printing press according to claim 5, wherein:

said outer surface of said form roller comprises a penetrable medium;

said plurality of protruding areas are configured to penetrate into said penetrable medium to a sufficient extent to permit the transfer of a rotational driving force from said distributor roller to said penetrable medium to drive said form roller.

7. The printing press according to claim 6, wherein:

said printing press comprises means for displacing said distributor roller in a direction parallel to the rotational axis of said distributor roller to laterally oscillate said distributor roller simultaneously with the driving of said distributor roller;

said plurality of protruding areas are configured to prevent tearing of said penetrable medium of said form roller during lateral oscillation of said distributor roller;

said plurality of protruding areas comprise a plurality of ridges disposed between said plurality of depressed areas, each of said plurality of ridges having a rounded surface for making contact with and penetrating said penetrable medium of said form roller;

each rounded area of each of said ridges has a peak corresponding to a maximum extent of protrusion of each of said ridges with respect to the rotational axis of said distributor roller;

each of said depressed areas has a portion of maximum depth, the portion of maximum depth corresponding to a maximum extent of recession of each of said depressed areas with respect to the rotational axis of said distributor roller;

each of said depressed areas has a depth dimension defined in a radial direction with respect to the rotational axis of said plate cylinder, the depth dimension being defined between the maximum extent of protrusion of each of said ridges and the portion of maximum depth of each of said depressed areas;

each of said ridges is configured to penetrate into said penetrable medium to a given degree of penetration to permit the transfer of a rotational driving force from said distributor roller to said penetrable medium to drive said form roller;

the given degree of penetration of each of said ridges into said penetrable medium being about two-fifths of the depth dimension of each of said depressed areas;

the depth dimension of each of said plurality of depressed areas being about 20 micrometers;

the given degree of penetration of each of said ridges into said penetrable medium being about 8 micrometers;

said parallel rows of said depressed areas are oriented substantially parallel to the rotational axis of said distributor roller;

said outer surface of said form roller being configured to have a damping medium film and an ink film disposed thereupon;

each of said plurality of ridges being configured to permeate the damping medium film and the ink film on said form roller simultaneously with penetration into said penetrable medium;

each of said plurality of depressed areas being generally cup-shaped;

said outer surface of said distributor roller comprising a chromium material; said penetrable medium of said outer surface of said form roller comprising an elastic material;

means for driving said plate cylinder;

control means for coordinating the driving of said plate cylinder with the driving of said distributor roller;

said control means comprising means for controlling said distributor roller driving means to drive said distributor roller, and said form roller, at a rotational speed different from that of said plate cylinder;

each of said depressed areas comprising:

a rounded lower portion, said rounded lower portion being in the form of a truncated spherical surface; and a frustoconical portion, said frustoconical portion extending between said rounded lower portion and said rounded portions of neighboring ones of said protruding portions, said frustoconical portion providing a smooth transition, at a tangent, into each of:

said rounded lower portion; and said rounded portions of said neighboring ones of said protruding portions;

a linear dimension being defined between portions of maximum depth of adjacent ones of said plurality of depressed areas, said linear dimension being defined parallel to the rotational axis of said distributor roller;

said rounded lower portion describing an arc of about 140 degrees;

said rounded lower portion having a center;

said top rounded portion of each of said ridges having a partially circular cross-section, as viewed in a cutting plane taken through said center of said rounded lower portion and parallel to the rotational axis of said distributor roller;

said partially circular cross-section describing an arc of about 115 degrees;

said rows of said plurality of depressed areas being arranged in at least one of the following patterns:

wherein neighboring ones of said plurality of depressed areas belonging to different rows of said plurality of depressed areas are diagonally offset with respect to one another; and wherein neighboring ones of said plurality of depressed areas belonging to different rows of said plurality of depressed areas are aligned linearly, parallel to the circumferential direction of said distributor roller, with respect to one another;

said portions of maximum depth of neighboring ones of said plurality of depressed areas, belonging to different rows of said plurality of depressed areas, being separated from one another by said linear dimension; and said linear dimension defined between said portions of maximum depth being about 1.8 times as great as said depth dimension of said each of said plurality of depressed areas.

8. Method of operating a printing press, such a printing press comprising: a frame; a plate cylinder being rotatably mounted on the frame; an inking unit for supplying ink to the plate cylinder; the inking unit comprising an ink fountain for containing ink, a plurality of inking rollers, means for transferring ink between the ink fountain and the plurality of inking rollers, a plurality of ink applicator rollers for transferring ink between the plurality of inking rollers and the plate cylinder; a damping unit for supplying damping medium to the plate cylinder; the damping unit comprising: a damping medium reservoir for containing damping medium; a form roller, being disposed adjacent the plate cylinder, for transferring damping medium to the plate cylinder; means for transferring damping medium from the damping medium reservoir to the form roller, the form roller having an outer surface; means for driving the distributor roller; the distributor roller for being disposed adjacent the form roller, for being rotatingly engaged with the form roller; said method comprising the steps of:

providing a frame;

providing a plate cylinder and rotatably mounting the plate cylinder on the frame;

providing an inking unit for supplying ink to the plate cylinder;

said step of providing the inking unit comprising:

providing an ink fountain for containing ink;

providing a plurality of inking rollers;

providing means for transferring ink between the ink fountain and the plurality of inking rollers;

providing a plurality of ink applicator rollers for transferring ink between the plurality of inking rollers and the plate cylinder;

providing a damping unit for supplying damping medium to the plate cylinder;

said step of providing the damping unit comprising:

providing a damping medium reservoir for containing damping medium;

providing a form roller and disposing the form roller adjacent the plate cylinder, for transferring damping medium to the plate cylinder, the form roller having an outer surface;

providing means for transferring damping medium from the damping medium reservoir to the form roller;

providing a distributor roller and disposing the distributor roller adjacent the form roller, the distributor roller for being rotatingly engaged with the form roller;

providing means for driving the distributor roller;

said step of providing the distributor roller comprising:

providing an outer cylindrical surface for engaging with the form roller;

configuring the distributor roller to rotate about a rotational axis;

configuring the outer cylindrical surface to have a longitudinal dimension defined parallel to the rotational axis and a circumferential dimension defined perpendicular to the longitudinal dimension;

disposing a plurality of depressed areas in the outer cylindrical surface of the distributor roller;

providing a plurality of protruding areas, such that the plurality of protruding areas separate the plurality of depressed areas from one another;

configuring the distributor roller driving means and the plurality of protruding areas to provide means for making contact with the outer surface of the form roller; and configuring the distributor roller driving means and the plurality of protruding areas to provide means for transferring a rotational driving force to the outer surface of the form roller to drive the form roller;

said method further comprising the additional steps driving the distributor roller with the means for driving the distributor roller; and driving the form roller, simultaneously with said step of driving the distributor roller, by transferring, with the plurality of protruding areas, a rotational driving force from the distributor roller to the form roller.

9. The method according to claim 8, further comprising the steps of:

configuring the outer surface of the form roller to comprise a penetrable medium; and configuring the plurality of protruding areas to penetrate into the penetrable medium to a sufficient extent to permit the transfer of a rotational driving force from the distributor roller to the penetrable medium to drive the form roller.

10. The method according to claim 9, further comprising the steps of:

providing means for displacing the distributor roller in a direction parallel to the rotational axis of the distributor roller to laterally oscillate the distributor roller simultaneously with the driving of the distributor roller; and configuring the plurality of protruding areas to prevent tearing of the penetrable medium of the form roller during lateral oscillation of the distributor roller.

11. The method according to claim 10, further comprising the step of:

configuring the plurality of protruding areas to comprise a plurality of ridges disposed between the plurality of depressed areas, each of the plurality of ridges having a rounded surface for making contact with and penetrating the penetrable medium of the form roller.

12. The method according to claim 11, wherein:

a substantial number of the plurality of depressed areas are disposed one after the other over at least a major portion of the longitudinal extent of the outer cylindrical surface of the distributor roller; and a substantial number of the plurality of depressed areas are disposed one after the other over at least a major portion of the circumferential extent of the outer cylindrical surface of the distributor roller.

13. The method according to claim 12, wherein:

the plurality of depressed areas are disposed substantially immediately adjacent one another, in a substantially uniform pattern, over at least a major portion of the longitudinal extent of the outer cylindrical surface of the distributor roller; and a major portion of the circumferential extent of the outer cylindrical surface of the distributor roller.

14. The method according to claim 13, further comprising the step of configuring the printing press such that:

the plurality of depressed areas are disposed over substantially the entire longitudinal extent of the outer cylindrical surface of the distributor roller; and substantially the entire circumferential extent of the outer cylindrical surface of the distributor roller.

the plurality of depressed areas are arranged in a plurality of rows, the plurality of rows being disposed parallel to one another;

each rounded area of each of the ridges has a peak corresponding to a maximum extent of protrusion of each of the ridges with respect to the rotational axis of the distributor roller;

each of the depressed areas has a portion of maximum depth, the portion of maximum depth corresponding to a maximum extent of recession of each of the depressed areas with respect to the rotational axis of the distributor roller;

each of the depressed areas has a depth dimension defined in a radial direction with respect to the rotational axis of the plate cylinder, the depth dimension being defined between the maximum extent of protrusion of each of the ridges and the portion of maximum depth of each of the depressed areas;

each of the ridges is configured to penetrate into the penetrable medium to a given degree of penetration to permit the transfer of a rotational driving force from the distributor roller to the penetrable medium to drive the form roller;

the given degree of penetration of each of the ridges into the penetrable medium being about two-fifths of the depth dimension of each of the depressed areas;

the depth dimension of each of the plurality of depressed areas being about 20 micrometers;

the given degree of penetration of each of the ridges into the penetrable medium being about 8 micrometers;

the parallel rows of the depressed areas being oriented substantially parallel to the rotational axis of the distributor roller;

the outer surface of the form roller being configured to have a damping medium film and an ink film disposed thereupon;

each of the plurality of ridges being configured to permeate the damping medium film and the ink film on the form roller simultaneously with penetration into the penetrable medium;

each of the plurality of depressed areas being generally cup-shaped;

the outer surface of the distributor roller comprising a chromium material;

the penetrable medium of the outer surface of the form roller comprising an elastic material;

means for driving the plate cylinder;

control means for coordinating the driving of the plate cylinder with the driving of the distributor roller;

the control means comprising means for controlling the distributor roller driving means to drive the distributor roller, and the form roller, at a rotational speed different from that of the plate cylinder;

each of the depressed areas comprising:

a rounded lower portion, the rounded lower portion being in the form of a truncated spherical surface; and a frustoconical portion, the frustoconical portion extending between the rounded lower portion and the rounded portions of neighboring ones of the protruding portions, the frustoconical portion providing a smooth transition, at a tangent, into each of:

the rounded lower portion; and the rounded portions of the neighboring ones of the protruding portions;

a linear dimension being defined between portions of maximum depth of adjacent ones of the plurality of depressed areas, the linear dimension being defined parallel to the rotational axis of the distributor roller;

the rounded lower portion describing an arc of about 140 degrees;

the rounded lower portion having a center;

the top rounded portion of each of the ridges having a partially circular cross-section, as viewed in a cutting plane taken through the center of the rounded lower portion and parallel to the rotational axis of the distributor roller;

the partially circular cross-section describing an arc of about 115 degrees;

the rows of the plurality of depressed areas being arranged in at least one of the following patterns:

wherein neighboring ones of the plurality of depressed areas belonging to different rows of the plurality of depressed areas are diagonally offset with respect to one another; and wherein neighboring ones of the plurality of depressed areas belonging to different rows of the plurality of depressed areas are aligned linearly, parallel to the circumferential direction of the distributor roller, with respect to one another;

the portions of maximum depth of neighboring ones of the plurality of depressed areas, belonging to different rows of the plurality of depressed areas, being separated from one another by the linear dimension; and the linear dimension defined between the portions of maximum depth being about 1.8 times as great as the depth dimension of the each of the plurality of depressed areas.

15. A distributor roller for a printing press, such a printing press comprising a frame; a plate cylinder being rotatably mounted on the frame; an inking unit for supplying ink to the plate cylinder; the inking unit comprising an ink fountain for containing ink, a plurality of inking rollers, means for transferring ink between the ink fountain and the plurality of inking rollers, a plurality of ink applicator rollers for transferring ink between the plurality of inking rollers and the plate cylinder; a damping unit for supplying damping medium to the plate cylinder; the damping unit comprising a damping medium reservoir for containing damping medium; a form roller, being disposed adjacent the plate cylinder, for transferring damping medium to the plate cylinder; means for transferring damping medium from the damping medium reservoir to the form roller, the form roller having an outer surface; means for driving the distributor roller; said distributor roller for being disposed adjacent the form roller, for being rotatingly engaged with the form roller; said distributor roller comprising:

an outer cylindrical surface for engaging with the form roller;

a rotational axis;

said outer cylindrical surface having a longitudinal dimension defined parallel to said rotational axis and a circumferential dimension defined perpendicular to the longitudinal dimension;

a plurality of depressed areas disposed in said outer cylindrical surface of said distributor roller;

a plurality of protruding areas separating said plurality of depressed areas from one another;

said plurality of protruding areas and said distributor roller driving means being configured to provide means for making contact with the outer surface of the form roller; and said plurality of protruding areas and said distributor roller driving means being configured to provide means for transferring a rotational driving force to the outer surface of the form roller to drive the form roller.

16. The distributor roller according to claim 15, wherein:

the outer surface of the form roller comprises a penetrable medium; and said plurality of protruding areas are configured to penetrate into the penetrable medium to a sufficient extent to permit the transfer of a rotational driving force from said distributor roller to the penetrable medium to drive the form roller.

17. The distributor roller according to claim 16, wherein:

said printing press comprises means for displacing said distributor roller in a direction parallel to the rotational axis of said distributor roller to laterally oscillate said distributor roller simultaneously with the driving of said distributor roller; and said plurality of protruding areas are configured to prevent tearing of the penetrable medium of the form roller during lateral oscillation of said distributor roller.

18. The distributor roller according to claim 17, wherein:

said plurality of protruding areas comprise a plurality of ridges disposed between said plurality of depressed areas; and each of said plurality of ridges has a rounded surface for making contact with and penetrating the penetrable medium of the form roller.

19. The distributor roller according to claim 18, wherein:

a substantial number of said plurality of depressed areas are disposed one after the other over at least a major portion of the longitudinal extent of said outer cylindrical surface of said distributor roller; and a substantial number of said plurality of depressed area are disposed one after the other over at least a major portion of the circumferential extent of said outer cylindrical surface of said distributor roller.

20. The distributor roller according to claim 19, wherein:

said plurality of depressed areas are disposed substantially immediately adjacent one another, in a substantially uniform pattern, over:

substantially the entire longitudinal extent of said outer cylindrical surface of said distributor roller; and substantially the entire circumferential extent of said outer cylindrical surface of said distributor roller;

said plurality of depressed areas being arranged in a plurality of rows, said plurality of rows being disposed parallel to one another;

each rounded area of each of said ridges has a peak corresponding to a maximum extent of protrusion of each of said ridges with respect to the rotational axis of said distributor roller;

each of said depressed areas has a portion of maximum depth, the portion of maximum depth corresponding to a maximum extent of recession of each of said depressed areas with respect to the rotational axis of said distributor roller;

each of said depressed areas has a depth dimension defined in a radial direction with respect to the rotational axis of said plate cylinder, the depth dimension being defined between the maximum extent of protrusion of each of said ridges and the portion of maximum depth of each of said depressed areas;

each of said ridges is configured to penetrate into the penetrable medium to a given degree of penetration to permit the transfer of a rotational driving force from said distributor roller to the penetrable medium to drive the form roller;

the given degree of penetration of each of said ridges into the penetrable medium being about two-fifths of the depth dimension of each of said depressed areas;

the depth dimension of each of said plurality of depressed areas being about 20 micrometers the given degree of penetration of each of said ridges into the penetrable medium being about 8 micrometers;

said parallel rows of said depressed areas being oriented substantially parallel to the rotational axis of said distributor roller;

said outer surface of the form roller being configured to have a damping medium film and an ink film disposed thereupon;

each of said plurality of ridges being configured to permeate the damping medium film and the ink film on the form roller simultaneously with penetration into the penetrable medium;

each of said plurality of depressed areas being generally cup-shaped;

said outer surface of said distributor roller comprising a chromium material;

the penetrable medium of said outer surface of the form roller comprising an elastic material;

means for driving said plate cylinder;

control means for coordinating the driving of said plate cylinder with the driving of said distributor roller;

said control means comprising means for controlling said distributor roller driving means to drive said distributor roller, and the form roller, at a rotational speed different from that of said plate cylinder;

each of said depressed areas comprisings a rounded lower portion, said rounded lower portion being in the form of a truncated spherical surface; and a frustoconical portion, said frustoconical portion extending between said rounded lower portion and said rounded portions of neighboring ones of said protruding portions, said frustoconical portion providing a smooth transition, at a tangent, into each of:

said rounded lower portion; and said rounded portions of said neighboring ones of said protruding portions;

a linear dimension being defined between portions of maximum depth of adjacent ones of said plurality of depressed areas, said linear dimension being defined parallel to the rotational axis of said distributor roller;

said rounded lower portion describing an arc of about 140 degrees said rounded lower portion having a center;

said top rounded portion of each of said ridges having a partially circular cross-section, as viewed in a cutting plane taken through said center of said rounded lower portion and parallel to the rotational axis of said distributor roller;

said partially circular cross-section describing an arc of about 115 degrees said rows of said plurality of depressed areas being arranged in at least one of the following patterns:

wherein neighboring ones of said plurality of depressed areas belonging to different rows of said plurality of depressed areas are diagonally offset with respect to one another; and wherein neighboring ones of said plurality of depressed areas belonging to different rows of said plurality of depressed areas are aligned linearly, parallel to the circumferential direction of said distributor roller, with respect to one another;

said portions of maximum depth of neighboring ones of said plurality of depressed areas, belonging to different rows of said plurality of depressed areas, being separated from one another by said linear dimension; and said linear dimension defined between said portions of maximum depth being about 1.8 times as great as said depth dimension of said each of said plurality of depressed areas.

* * * * *

UNITED STATES PATENT AND TRADEMARK OFFICE

CERTIFICATE OF CORRECTION

PATENT NO. : 5,471,926

DATED : December 5, 1995

INVENTOR(S) : Rudi JUNGHANS and Mathias ZUBER

It is certified that error appears in the above-indentified patent and that said Letters Patent is hereby corrected as shown below:

On the title page, INID [30], in the Foreign Application Priority Data section, delete "930742 U" and insert -- 9305742 U --.

On the title page, INID [57], line 11 of the Abstract section, after 'a' delete "form" and insert --forme--.

On the title page, INID [57], line 15 of the Abstract section, after 'the' delete "form" and insert --forme--.

On the title page, INID [57], line 16 of the Abstract section, after the first occurrence of 'the' delete "form" and insert --forme--.

On the title page, INID [57], line 23 of the Abstract section, before 'roller' delete "form" and insert --forme--.

On the title page, INID [57], line 24 of the Abstract section, after the second occurrence of 'the' delete "form" and insert --forme--.

On the title page, INID [57], line 25 of the Abstract section, after 'the' delete "form" and insert --forme--.

In column 1, line 18, after 'the' delete "form" and insert --forme--.

UNITED STATES PATENT AND TRADEMARK OFFICE

CERTIFICATE OF CORRECTION

PATENT NO. : 5,471,926

DATED : December 5, 1995

INVENTOR(S) : Rudi JUNGHANS and Mathias ZUBER

It is certified that error appears in the above-indentified patent and that said Letters Patent is hereby corrected as shown below:

In column 3, line 20, after 'disposing' delete "he" and insert --the--.

In column 3, line 62, before 'medium' delete "duping" and insert --damping--.

In column 3, line 66, after the second occurrence of 'roller' delete "comprisings" and insert --comprising:--.

In column 4, line 46, before 'in' delete "viewed" and insert --Viewed--.

In column 5, line 61, after 'the' delete "forms-roller" and insert --forme roller--.

In column 8, line 31, after '7' delete "end" and insert --and--.

In column 8, line 57, after 'roller' delete "I" and insert --1--.

In column 9, line 50, after 'to' delete "Mossmiller" and insert --Mosemiller--.

In column 10, line 4, after 'elsewhere,' delete "end" and insert --and--.

In column 10, line 21, Claim 1, after 'said' delete "free" and insert --frame--.

UNITED STATES PATENT AND TRADEMARK OFFICE

CERTIFICATE OF CORRECTION

PATENT NO. : 5,471,926

DATED : December 5, 1995

INVENTOR(S) : Rudi JUNGHANS and Mathias ZUBER

It is certified that error appears in the above-indentified patent and that said Letters Patent is hereby corrected as shown below:

In column 14, line 26, Claim 8, after "steps" insert --of:--.

In column 18, line 55 Claim 20, after 'areas' delete "comprisings" and insert --comprising:--.

Signed and Sealed this

Twenty-second Day of October, 1996

*Attest:*

Bruce Lehman

BRUCE LEHMAN

*Attesting Officer*

*Commissioner of Patents and Trademarks*